US007044765B1

(12) United States Patent
Lee et al.

(10) Patent No.: US 7,044,765 B1
(45) Date of Patent: May 16, 2006

(54) MATRIX BOARD TO BOARD CONNECTOR ASSEMBLY

(75) Inventors: Shih-An Lee, Tu-Cheng (TW); Yung-Chi Peng, Tu-Cheng (TW)

(73) Assignee: Cheng Uei Precision Industry Co., Ltd., Taipie Hsien (TW)

( * ) Notice: Subject to any disclaimer, the term of this patent is extended or adjusted under 35 U.S.C. 154(b) by 0 days.

(21) Appl. No.: 11/144,716

(22) Filed: Jun. 4, 2005

(51) Int. Cl.
*H01R 13/627* (2006.01)

(52) U.S. Cl. ..... 439/354

(58) Field of Classification Search ..... 439/352, 439/353, 354, 357
See application file for complete search history.

(56) References Cited

U.S. PATENT DOCUMENTS 5,487,678 A * 1/1996 Tsuji et al. ..... 439/352

* cited by examiner

*Primary Examiner*—Javaid H. Nasri

(57) ABSTRACT

A matrix board to board connector assembly includes a first connector and a second connector. A first locking piece is provided and fixed on the first connector. The first locking piece has a locking portion bend from a lower edge thereof and extending sideward and outward. A second locking piece is provided with an elastic portion and fixed on the second connector. The elastic portion is configured to provide a spring end. The spring end is firstly protruded and then concaved at its free end. During mating of the first and the second connectors, the spring end is firstly deflected and then elastically recovered to hit on the locking portion with a click to insure that the first and the second connectors have been properly mated.

7 Claims, 7 Drawing Sheets

MATRIX BOARD TO BOARD CONNECTOR ASSEMBLY

BACKGROUND OF THE INVENTION

1. Field of the Invention

The present invention generally relates to a board to board connector assembly, and more particularly, to a matrix board to board connector assembly.

2. The Related Art

A prior matrix board to board connector assembly 20 shown in FIG. 10, is composed of a first connector 300 and a second connector 400 which are used to be respectively mounted on individual printed circuit boards (not shown in drawings). The printed circuit boards are electrically connected by the mating of the first and the second connectors 300, 400.

With reference to FIG. 11, the first connector 300 includes a first insulating housing 310 and a plurality of first conducting terminals 320 fixed in the first insulating housing 310. The first insulating housing 310 has a base plate 311 which defines an indentation 313 in each corner thereof. A pair of side walls 314 extends upward and vertically from the right and left sides of the base plate 311, thereby defining a space for holding the second connector 400. Each end of the side wall 314 forms a block arm 315 whose free end is protruded to form a first locking protrusion 316 for securing the second connector 400 on the first connector 300.

With reference to FIG. 12, the second connector 400 includes a second insulating housing 410 and a plurality of second conducting terminals 420 fixed in the second insulating housing 410. The second insulating housing 410 provides a fixing leg 412 extending upwardly and a second locking protrusion 416 extending sideward in each corner thereof. When the second connector 400 is inserted into the first connector 300, the fixing leg 412 of the second connector 400 is inserted into the corresponding indentation 313 of the first connector 300, and the second locking protrusion 416 is locked with the first locking protrusion 316, thereby connecting the two connectors 300, 400 together.

However, the first locking protrusion 316 and the second locking protrusion 416 only have the function of locking the two connectors 300,400, when the second connector 400 is inserted into the first connectors 300, a user has no way to judge when and whether the two connectors 300,400 have been properly mated.

SUMMARY OF THE INVENTION

An object of the present invention is to provide a matrix board to board connector assembly having a locking mechanism capable of providing a click feeling for users when the first connector and the second connector of the assembly are mated to insure that the first connector and the second connector are properly mated.

To achieve the above object, the present invention provides a matrix board to board connector assembly including a first connector and a second connector. The first connector includes a first insulating housing and a plurality of first conducting terminals. The first insulating housing has a first base plate and side walls extending upwardly and vertically from edges of the first base plate. The first base plate defines indentations in the side walls. The first conducting terminals are fixed in the first base plate and arranged in matrix array. The second connector includes a second insulating housing and a plurality of second conducting terminals. The second insulating housing has a second base plate and leading walls extending downwardly and vertically from edges of the second base plate. The second conducting terminals are fixed in the second base plate and arranged in matrix array. The leading walls are inserted into the corresponding indentations of the first connector to latch the first connector and the second connector when the first connector and the second connector are mated. A fixing slot and a holding slot are formed in the leading wall, wherein the fixing slot opens to a top surface of the leading wall, and the holding slot communicates with the fixing slot and is exposed to an outer side of the leading wall. The first connector further includes a first locking piece fixed to the side wall of the first insulating housing. The first locking piece has a locking portion bent from a lower edge thereof and extending sideward and outward. The second connector further includes a second locking piece which has an elastic portion and is fixed in the fixing slot with the elastic portion partially received in the holding slot and partially extended out of the holding slot. The elastic portion of the second locking piece is configured to provide a spring end, and the spring end is firstly protruded and then concaved at its free end. During mating of the first and the second connectors, the spring end of the second locking piece is firstly deflected and then elastically recovered to hit on the locking portion of the first locking piece with a click to insure that the first and the second connectors have been properly mated.

As can be seen from the above description, the spring end of the second locking piece is firstly deflected and then elastically recovered to hit on the locking portion of the first locking piece with a click during mating of the first and the second connectors, therefore the users can insure that the first connector and the second connector are properly mated.

BRIEF DESCRIPTION OF THE DRAWINGS

The present invention will be apparent to those skilled in the art by reading the following description of embodiment thereof, with reference to the attached drawings, in which.

DETAILED DESCRIPTION OF THE PREFERRED EMBODIMENT

Figure 1:
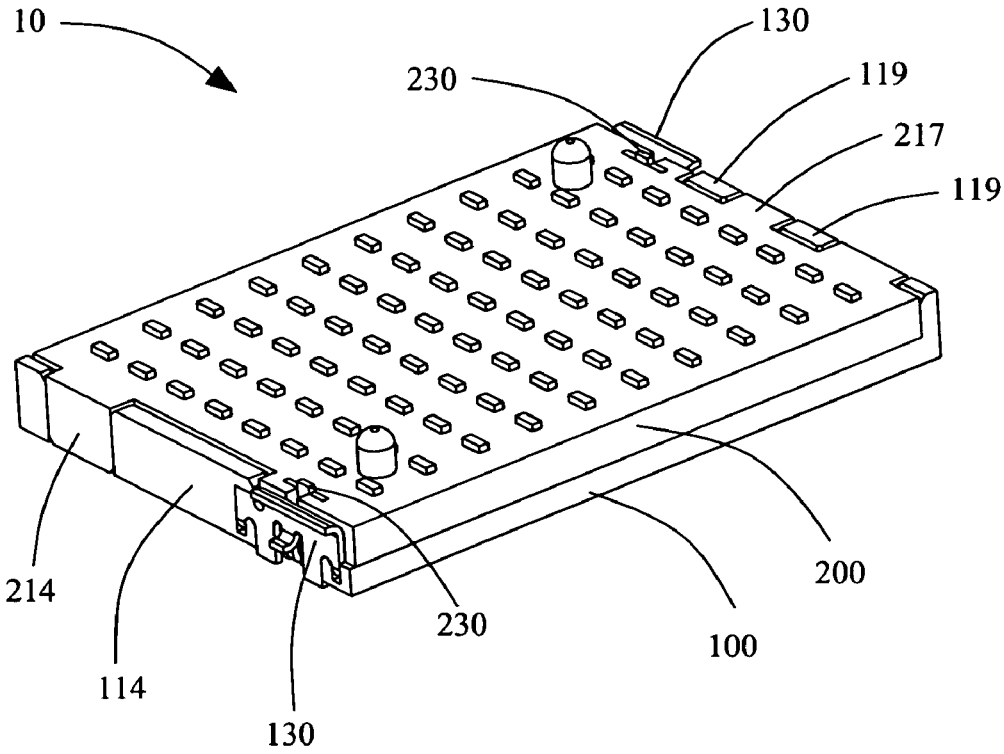
FIG. 1 is a perspective view of a matrix board to board connector assembly according to the present invention.

With reference to FIG. 1, a matrix board to board connector assembly 10 according to the present invention includes a first connector 100 and a second connector 200 which are used to be respectively mounted on individual printed circuit boards (not shown in drawings) to electrically connect the printed circuit boards by mating the two connectors 100, 200.

Figure 2:
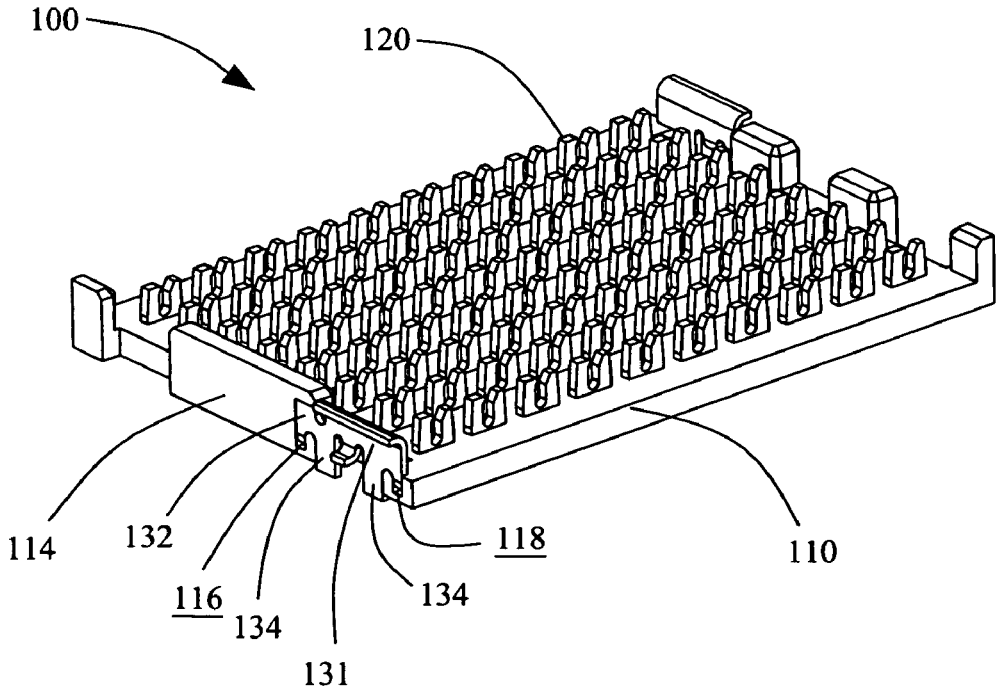
FIG. 2 is a perspective view of a first connector of the matrix board to board connector assembly shown in FIG. 1.
Figure 3:
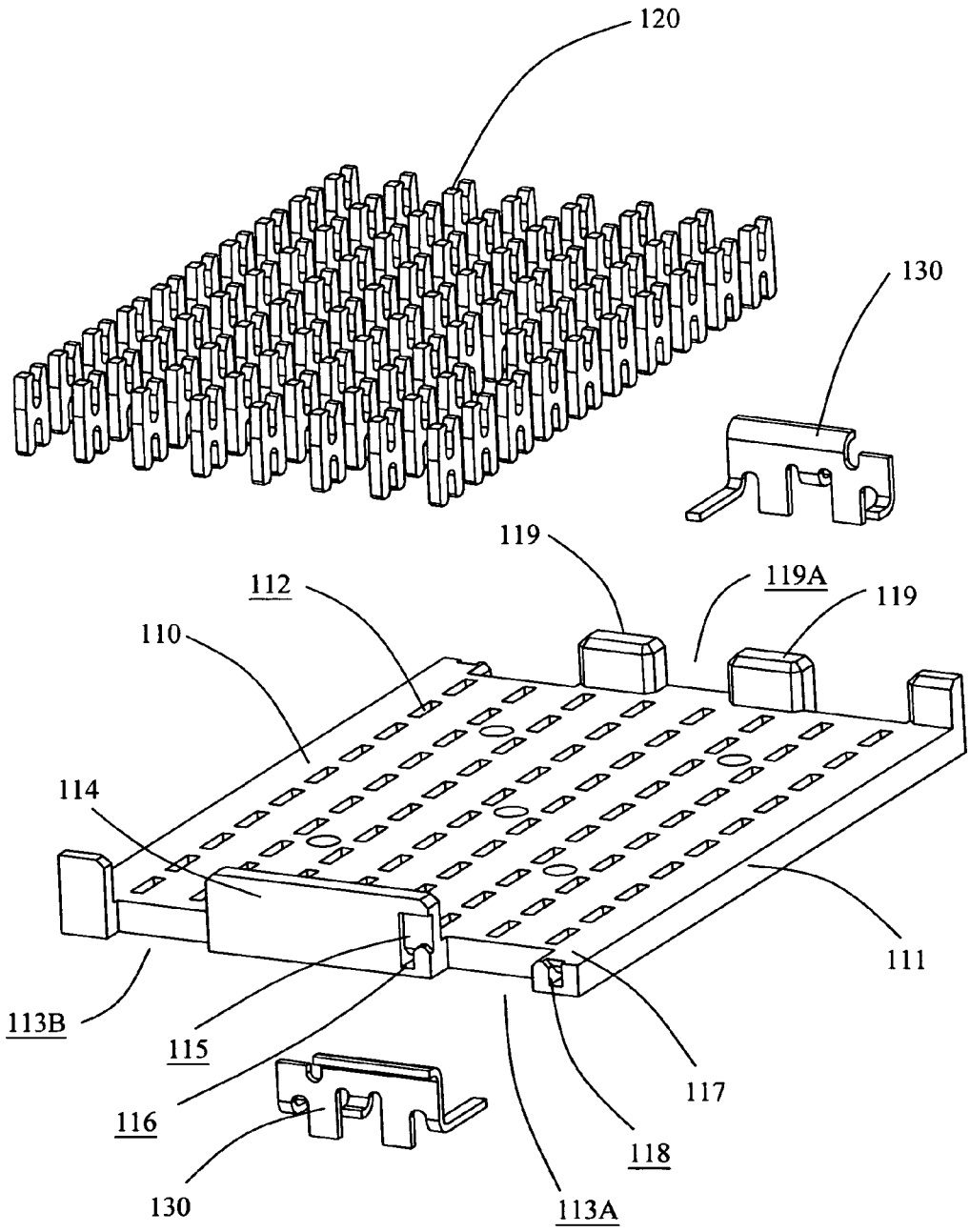
FIG. 3 is an exploded perspective view of the first connector shown in FIG. 2.

With reference to FIG. 2 and FIG. 3, the first connector 100 includes a first insulating housing 110, a plurality of first conducting terminals 120 and two first locking pieces 130. The first insulating housing 110 has a first base plate 111. The first base plate 111 defines a plurality of first terminal slots 112 which are arranged in matrix array for fixing the first conducting terminals 120 therein in matrix array. A first indentation 113A and a second indentation 113B are defined at both of the front and the rear ends of the first base plate 111. The front end of the first base plate 111 forms a first side wall 114 extending upwardly and vertically between the first and the second indentations 113A, 113B. A locking slot 115 is opened on the first side wall 114 near to the first indentation 113A. A first fixing hole 116 is also opened on the first side wall 114 close to the locking slot 115 and further extending into the first base plate 111. The first base plate 111 provides a bar 117 near to each first indentation 113A. A second fixing hole 118 is opened on the bar 117 in parallel with the first fixing hole 116. The rear end of the first base plate 111 forms a pair of separate second side walls 119 extending upwardly and vertically between the first and the second indentations 113A, 113B with a polarization slot 119A defined between the pair of second side walls 119.

Figure 4:
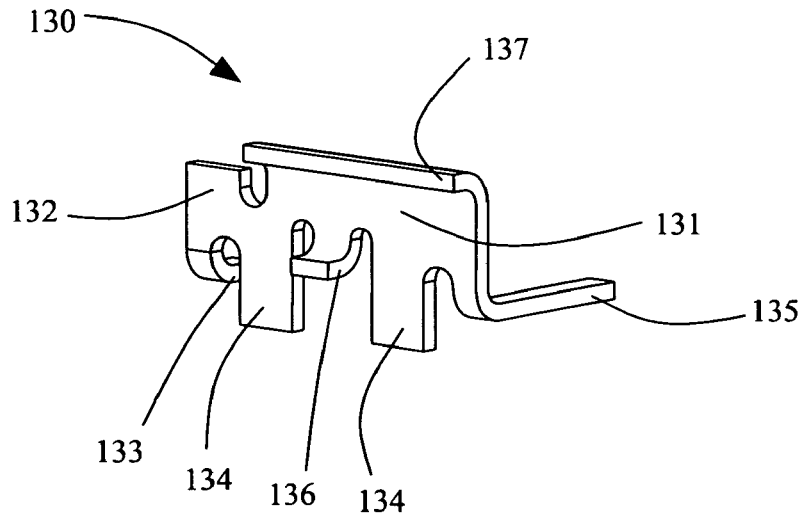
FIG. 4 is a perspective view of a first locking piece of the first connector shown in FIG. 3.

With reference to FIG. 4, the first locking piece 130 is made of metal sheet, which has a first base portion 131, a fixing portion 132 extending leftward from the left edge of the first base portion 131, two first soldering legs 134 extending downward from the lower edge of the first base portion 131, and a locking portion 136 bent from the lower edge of the first base portion 131 and extending sideward and outward between the two first soldering legs 134. The first locking piece 130 further has a first fixing leg 133 and a second fixing leg 135 extending in parallel and opposite to the locking portion 136 from the lower edge of the first base portion 131. An arced rim 137 is bend from the upper edge of the first base portion 131 and extends sideward and outward.

With reference to FIG. 2 again, when the first locking piece 130 is fixed in the first insulating housing 110, the fixing portion 132 is held and fixed in the locking slot 115, and the first fixing leg 133 and the second fixing leg 135 are inserted into the first fixing hole 116 and the second fixing hole 118 respectively. The two first soldering legs 134 pass through the first indentation 113A and extend below the bottom surface of the first base plate 111 of the first insulating housing 110 for being soldered on the printed circuit board (not shown in drawings).

Figure 5:
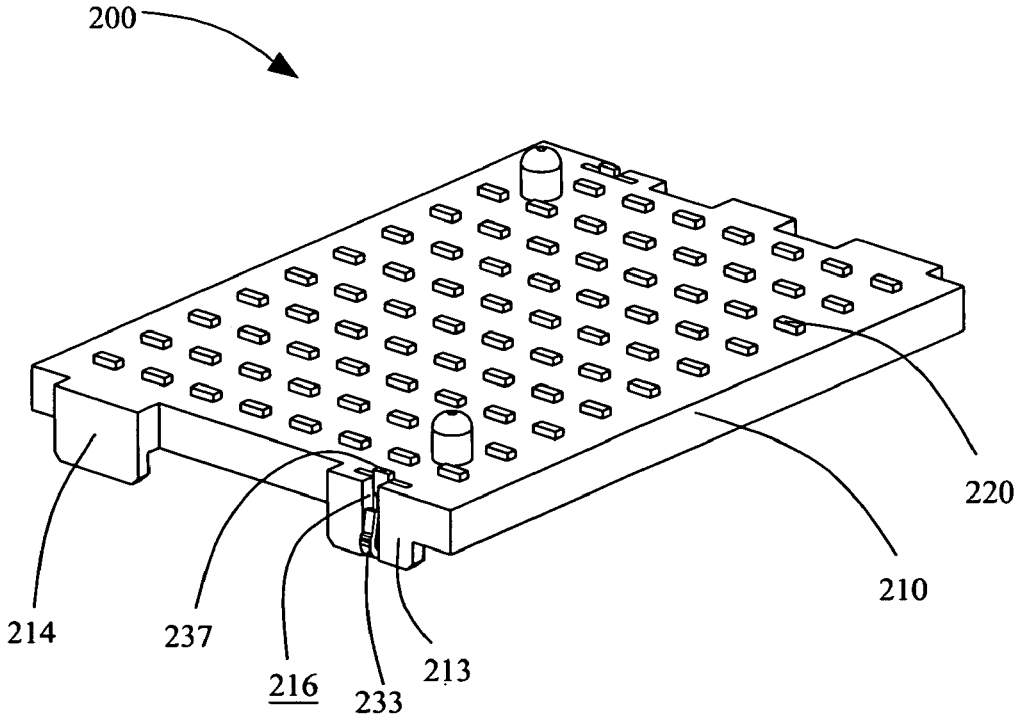
FIG. 5 is a perspective view of a second connector of the matrix board to board connector assembly shown in FIG. 1.
Figure 6:
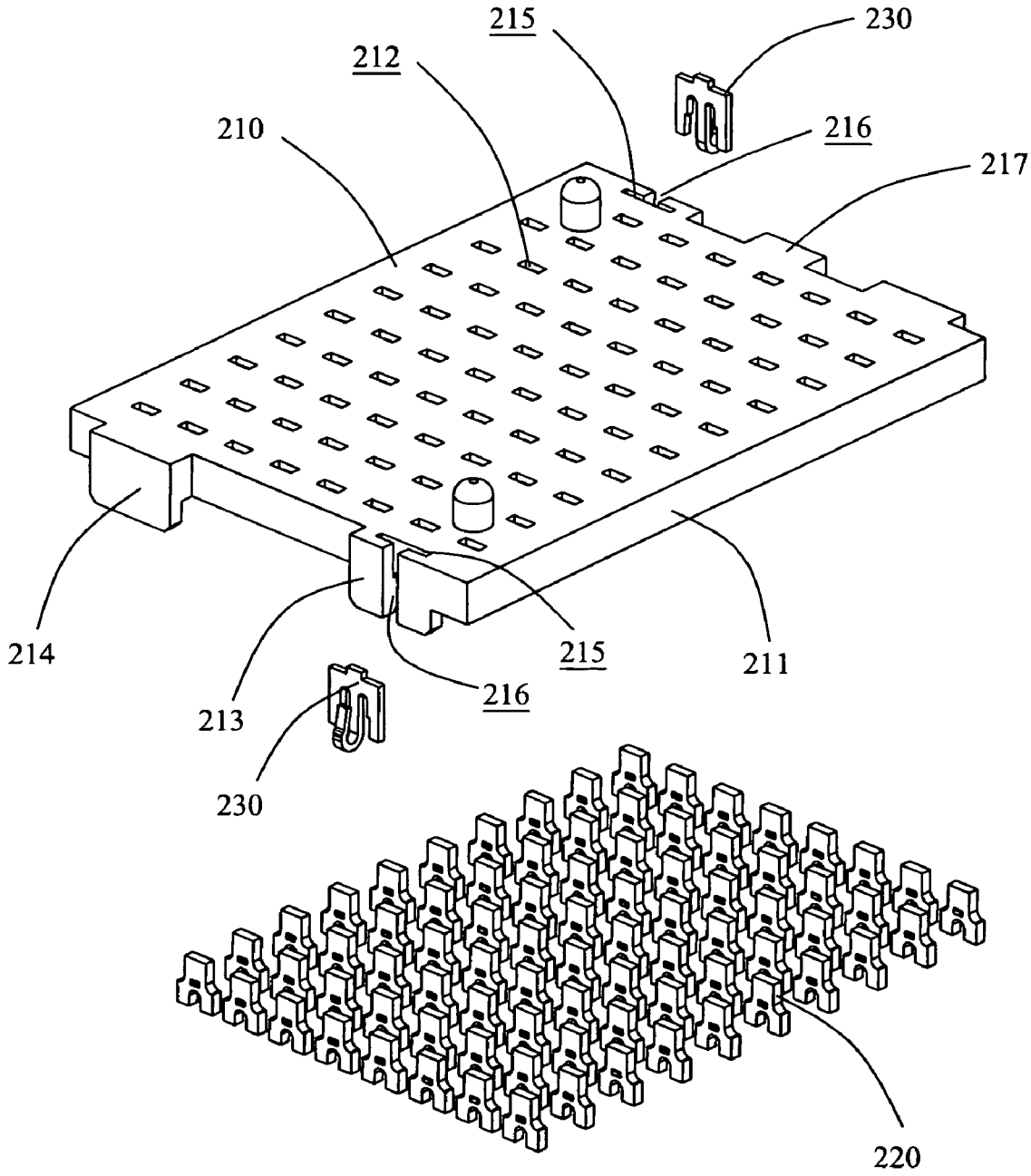
FIG. 6 is an exploded perspective view of the second connector shown in FIG. 5.

With reference to FIG. 5 and FIG. 6, the second connector 200 includes a second insulating housing 210, a plurality of second conducting terminals 220 and two second locking pieces 230. The second insulating housing 210 has a second base plate 211. The second base plate 211 defines a plurality of second terminal slots 212 which are arranged in matrix array for fixing the second conducting terminals 220 therein in matrix array. A first leading wall 213 and a second leading wall 214 extend downwardly and vertically from both of the front and rear ends of second base plate 211. A fixing slot 215 and a holding slot 216 are formed in the leading wall 214, wherein the fixing slot 215 opens to a top surface of the leading wall 214, and the holding slot 216 communicates with the fixing slot 215 and is exposed to an outer side of the leading wall 214. A polarization block 217 is provided at the rear of the second base plate 211.

Figure 7:
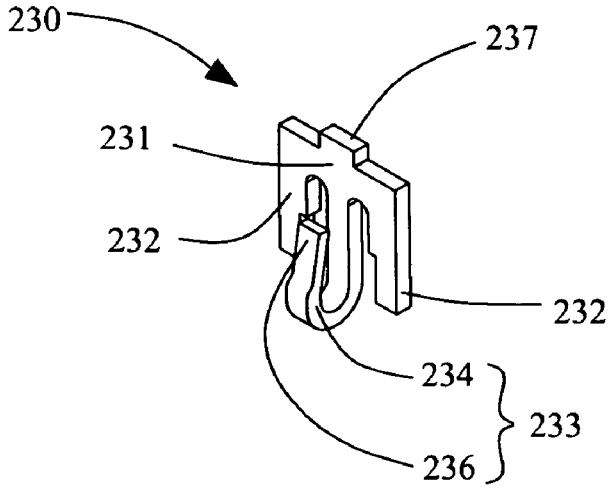
FIG. 7 is a perspective view of a second locking piece of the second connector shown in FIG. 6.

With reference to FIG. 7, the second locking piece 230 is also made of metal sheet, which has a second base portion 231, an elastic portion 233 and a second soldering leg 237. The elastic portion 233 extends from the lower edge of the second base portion 231 and is shaped into a "U", one leg of which connects the second base portion 231, and the other leg of which is free. The free leg is configured to provide a spring end 234. The spring end 234 is firstly protruded and then concaved at its free end 236. The second soldering leg 237 extends upward from the upper edge of the second base portion 231. The second locking piece 230 further provides two holding arms 232 extending downwardly from the lower edge of the second base portion 231 and set in both sides of the elastic portion 233.

With reference to FIG. 5 again, when the second locking piece 230 is fixed in the second insulating housing 210, the second base portion 231 and the two holding arms 232 are held and fixed in the fixing slot 215 with the second soldering leg 237 extending above the top surface of the second base plate 211 of the second insulating housing 210 for being soldered on the printed circuit board (not shown in drawings). The elastic portion 233 is partially received in the holding slot 216 and partially extended out of the holding slot 216 to make the spring end 234 extend to outside.

Figure 8:
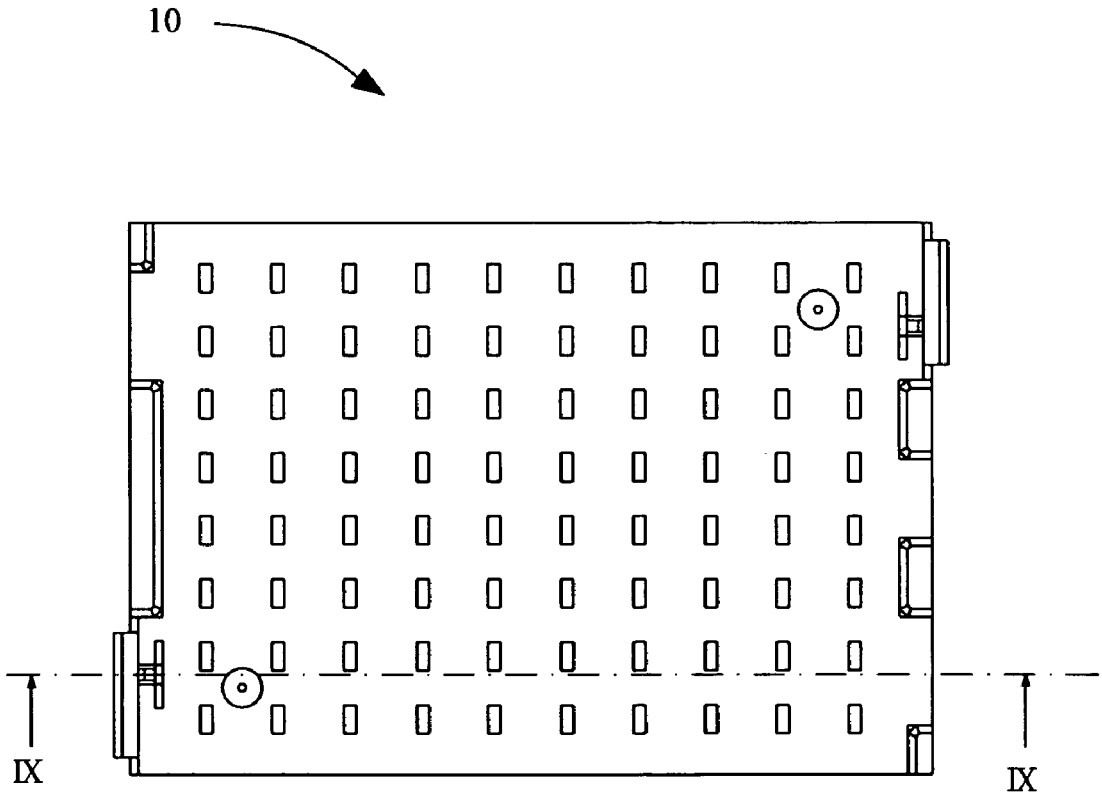
FIG. 8 is a top plan view of the matrix board to board connector assembly shown in FIG. 1.
Figure 9:
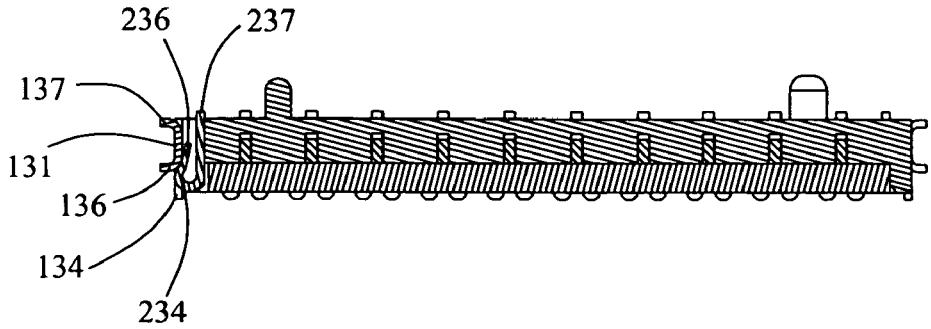
FIG. 9 is a cross-sectional view of the matrix board to board connector assembly taken along line IX—IX of FIG. 8.
Figure 10:
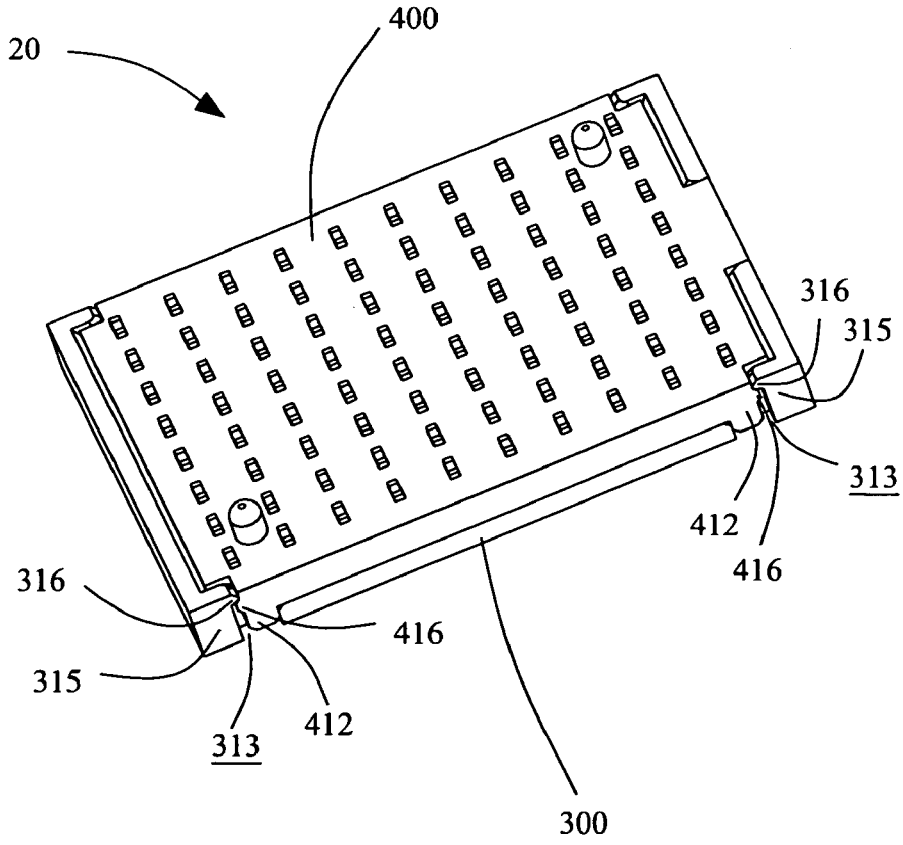
FIG. 10 ( PRIOR ART )
FIG. 10 is a perspective view of a matrix board to board connector assembly according to a prior art.
Figure 11:
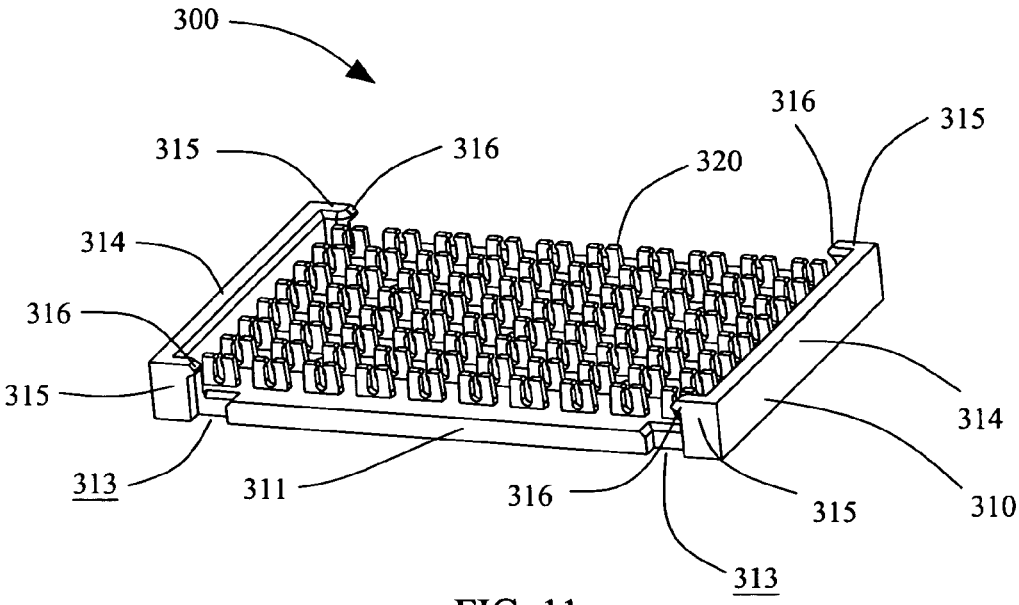
FIG. 11 ( PRIOR ART )
FIG. 11 is a perspective view of a first connector of the matrix board to board connector assembly shown in FIG. 10.
Figure 12:
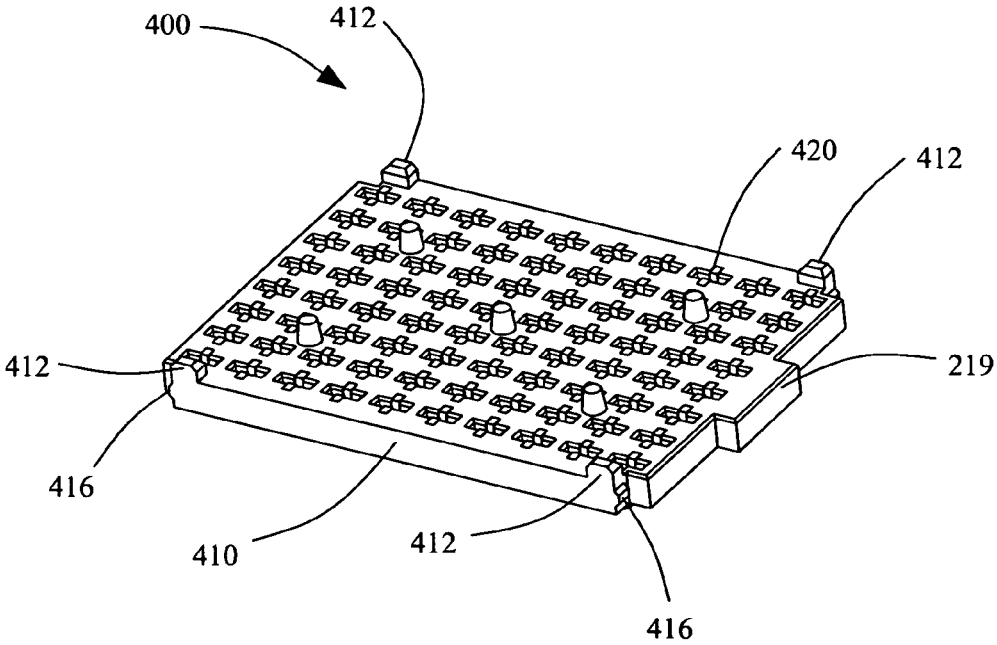
FIG. 12 ( PRIOR ART )
FIG. 12 is a perspective view of a second connector of the matrix board to board connector assembly shown in FIG. 10.

With reference to FIG. 1, FIG. 8 and FIG. 9, when the second connector 200 and the first connector 100 are mated, the first leading wall 213 and the second leading wall 214 of the second connector 200 are inserted into the first indentation 113A and the second indentation 113B of the first connector 100 respectively to lead the second connector 200 to be inserted into the first connector 100 and latch the two connectors 100, 200 together. The polarization block 217 of the second connector 200 is inserted into the polarization slot 119A of the first connector 100 to prevent the two connectors 100,200 from being misaligned. During the insertion of the second connector 200 into the first connector 100, the spring end 234 of the second locking piece 230 firstly leans against the first base portion 131 of the first locking piece 130 and is deflected. When the two connectors 100,200 are properly mated, the spring end 234 skims over the first base portion 131 and elastically recovers its original shape to hit on the locking portion 136 of the first locking piece 130, making a sound of click to insure that the two connectors 100,200 have been properly mated. Furthermore, the arced rim 137 also leads the insertion of the second connector 200 into the first connector 100, which can avoid the upper edge of the first base portion 131 blocking the second connector 200.

According to the mentioned above, the elastic portion 233 of the second locking piece 230 leans against the first base portion 131 of the first locking piece 130 and is deflected during the second connector 200 being mated with the first connector 100, and when the first and second connectors 100, 200 are properly mated, the spring end 234 elastically recovers its original shape and hits the locking portion 136 of the first locking piece 130 to make a click. The user hereby judges the two connectors 100, 200 have been properly mated.

Although the invention has been described above by reference to a certain embodiment of the invention, the invention is not limited to the embodiment described above.

Modifications and variations of the embodiments described above will occur to those skilled in the art, in light of the above teachings.

What is claimed is:

1. A matrix board to board connector assembly comprising:

a first connector including a first insulating housing and a plurality of first conducting terminals, the first insulating housing having a first base plate and side walls extending upwardly and vertically from edges of the first base plate, the first conducting terminals being fixed in the first base plate and arranged in matrix array; and a second connector including a second insulating housing and a plurality of second conducting terminals, the second insulating housing having a second base plate and leading walls extending downwardly and vertically from edges of the second base plate, the second conducting terminals being fixed in the second base plate and arranged in matrix array;

wherein the first base plate defines indentations in the side walls for the leading wall of the second connector being inserted therein to latch the first connector and the second connector when the first connector and the second connector are mated;

a fixing slot and a holding slot are formed in the leading wall, the fixing slot opens to a top surface of the leading wall, the holding slot communicates with the fixing slot and is exposed to an outer side of the leading wall;

the first connector further includes a first locking piece fixed to the side wall of the first insulating housing, the first locking piece has a locking portion bent from a lower edge thereof and extending sideward and outward; and the second connector further includes a second locking piece which has an elastic portion, the second locking piece is fixed in the fixing slot with the elastic portion partially received in the holding slot and partially extended out of the holding slot, the elastic portion is configured to provide a spring end, the spring end is firstly protruded and then concaved at its free end, during mating of the first and the second connectors, the spring end is firstly deflected and then elastically recovered to hit on the locking portion of the first locking piece with a click to insure that the first and the second connectors have been properly mated.

2. The matrix board to board connector assembly as claimed in claim 1, wherein the side wall of the first connector provides a locking slot, and the first locking piece has a fixing portion inserted in the locking slot.

3. The matrix board to board connector assembly as claimed in claim 1, wherein the first locking piece further has a first fixing leg and a second fixing leg bent from the lower edge thereof and extending opposite to the locking portion, the first base plate defines a first fixing hole and a second fixing hole for receiving the first fixing leg and the second fixing leg respectively.

4. The matrix board to board connector assembly as claimed in claim 1, wherein the first locking piece further has an arced rim bend from an upper edge thereof and extending sideward and outward.

5. The matrix board to board connector assembly as claimed in claim 1, wherein the elastic portion of the second locking piece is U-shaped.

6. The matrix board to board connector assembly as claimed in claim 1, wherein the second locking piece further provides two holding arms extending downwardly from a lower edge thereof, and the two holding arms are held and fixed in the fixing slot of the second connector.

7. The matrix board to board connector assembly as claimed in claim 1, wherein the first locking piece has a first soldering leg extending downwardly from the lower edge thereof, and the second locking piece has a second soldering leg extending upwardly form an upper edge thereof.

* * * * *